US005197736A

United States Patent [19]

Backus et al.

[11] Patent Number: 5,197,736

[45] Date of Patent: Mar. 30, 1993

[54] ROTARY LOTTERY NUMBER GENERATING MEANS HAVING PERIPHERAL FIELDS PROPORTIONATELY SIZED

[76] Inventors: Alan L. Backus, 1550 Centinela Ave., No. 210, Los Angeles, Calif. 90025; Scott Blum, 750 N. Shoreline #36, Mountain View, Calif. 94043

[21] Appl. No.: 440,600

[22] Filed: Nov. 22, 1989

[51] Int. Cl.[5] ..... A63F 5/04

[52] U.S. Cl. ..... 273/142 R; 273/142 J; 273/143 R

[58] Field of Search ..... 273/138 R, 141 R, 142 R, 273/142 A-142 G, 142 J, 142 JA, 142 JD, 148 R, 269, 274, 146 R, 142 K, 87 G, 93 R, 138 A; 434/174, 198, 206

[56] References Cited

U.S. PATENT DOCUMENTS

| | | | |
|---|---|---|---|
| 1,054,341 | 2/1913 | Cowles | 273/146 |
| 1,517,433 | 12/1924 | Kelly | 273/93 R |
| 2,049,314 | 7/1986 | Parker et al. | 273/93 R |
| 2,141,723 | 12/1938 | Pieper | 273/93 R |
| 3,912,270 | 10/1975 | Trossman et al. | 273/87 G X |
| 4,037,845 | 7/1977 | Hooker | 273/138 A |
| 4,403,774 | 9/1983 | Turcotte et al. | 273/143 R |
| 4,448,419 | 5/1984 | Telnaes | 273/143 R |
| 4,692,863 | 9/1987 | Moosz | 273/138 A |
| 4,790,537 | 12/1988 | Smyth et al. | 273/143 R |
| 4,874,175 | 10/1989 | Fischer | 273/146 |

FOREIGN PATENT DOCUMENTS

| | | | |
|---|---|---|---|
| 2502761 | 7/1976 | Fed. Rep. of Germany | 273/142 J |
| 2638553 | 5/1990 | France | 273/142 JC |

OTHER PUBLICATIONS

"All Star Baseball", New York; Cadaco-Ellis-Originators of Games, *Playthings*, May 1947, p. 3.

*Primary Examiner*—V. Millin
*Assistant Examiner*—William M. Pierce
*Attorney, Agent, or Firm*—Keck, Mahin & Cate

[57] ABSTRACT

Apparatus to increase chance predictions of lottery numbers. Said apparatus comprised of random means for selecting lottery outcomes from among fields weighted proportional to statistical data to reflect past lottery outcomes.

Rotary means with peripheral fields sized based on moving averages of past lottery or game outcomes. Means to initiate and randomly terminate rotary motion of these rotary means.

6 Claims, 3 Drawing Sheets

ROTARY LOTTERY NUMBER GENERATING MEANS HAVING PERIPHERAL FIELDS PROPORTIONATELY SIZED

BACKGROUND—FIELD OF INVENTION

This invention relates to apparatus to increase chance predictions of lottery numbers.

BACKGROUND—DESCRIPTION OF PRIOR ART

Many states now conduct lottery games. For a player to win in these games, the player must choose a group of numbers which match winning numbers chosen by random process. As an example, in the California State Lottery, the LOTTO 6/49 (tm), in order for a player to win the grand prize, the player must match 6 numbers on a lottery ticket they have purchased, with 6 numbers selected by the state using a random process. Each of the 6 numbers can range from numbers 1 to 49 with the state selecting no duplicates.

Individuals have developed many systems for selecting prospective winning numbers. These systems include use numbers derived from birthdays, addresses, time, hunches etc. In addition, many states offer computer picked tickets where a player purchases a ticket with numbers chosen at random by a computer. All of these systems amount to random methods for choosing numbers.

OBJECTS AND ADVANTAGES

In view of the foregoing drawbacks and deficiencies of the prior art, it is an object of the present invention to provide apparatus which will increase accuracy of predicting winning lottery numbers.

It is another object of the present invention to provide embodiments which will be simple and easy to use.

Readers will find further objects and advantages of the invention from a consideration of the ensuing description and the accompanying drawings.

SUMMARY OF INVENTION

The present invention is directed to apparatus to increase chance predictions of lottery numbers To that end, means are provided to predict future lottery outcomes based on random projections weighted by historical lottery data.

DETAILED DESCRIPTION

Figure 1:
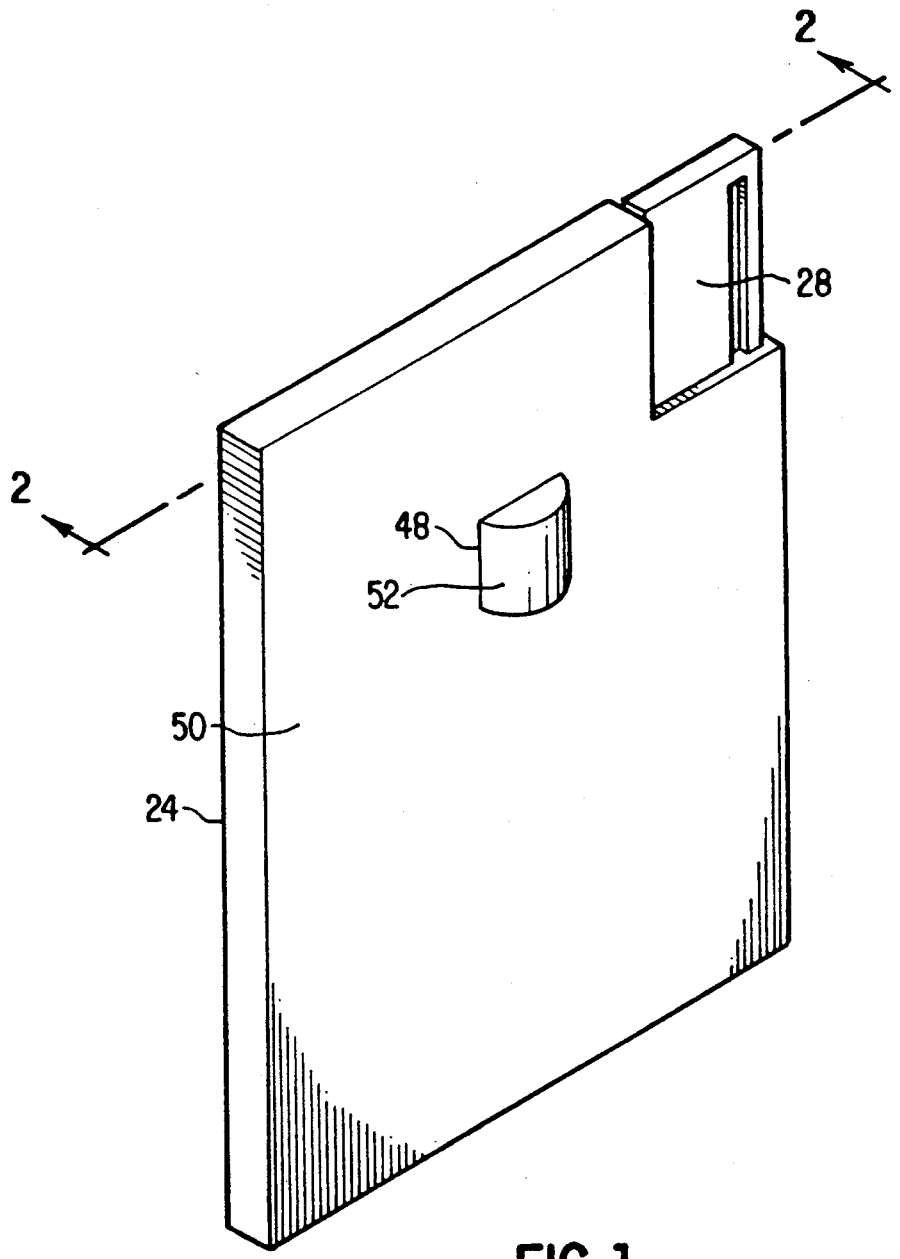
FIG. 1 is an isometric diagrammatic representation of a game playing device constructed in accord with the present invention.

Selection of winning lottery numbers by most states employs physical objects, such as ping pong balls rotated by drums or blown by air jets. Such physical objects, by their nature, bias the outcome of number selection.

As an example, a ping pong ball with slightly less bounce, or a minutely smaller diameter, or which is slightly heavier, or which has greater surface friction, may have a greater likelihood of falling into a hole in the bottom of rotating drum than its counterpart which doesn't possess such characteristics. Such inequalities between ping pong balls may be caused by manufacture, handling, age or other factors.

Most states use the same game setup for many games. As an example, California changes the ping pong balls it uses in its LOTTO 6/49 (tm) game only twice a year, which is the equivalent of using the same set of balls for an average of over 50 games.

Embodiments of the present invention use this natural bias to predict future game outcomes. This differs fundamentally from the systems for choosing lottery numbers describe above which are all essentially random.

There are many ways of utilizing data recording biases of physical objects to predict future events. A first example is a moving average encompassing data indicative of events occurring during a designated period of time.

An example of this is using events, or lottery drawings, which have occurred in during a 7 month period to predict the lottery numbers to be picked in the next 5 week period. This specific procedure was used to predict outcomes of the California LOTTO 6/49 (tm) lottery. Historical data from games run between Jan. 1, 1989 and Jul. 5, 1989 were used to predict the outcomes of all 10 California LOTTO 6/49 (tm) games occurring between Jul. 12, 1989 and Aug. 16, 1989.

The historical data from Jan. 1, 1989 to Jul. 5, 1989 is reflected in the following numbers. The odds show how often each number was selected during the 7 month period. Thus, as an example, the number 5 represented 1.2% (0.01211306) of the numbers drawn during that time period.

| number | odds | number | odds | number | odds |
|---|---|---|---|---|---|
| 1 | .01816958 | 2 | .02018843 | 3 | .01816958 |
| 4 | .01413190 | 5 | .01211306 | 6 | .01413190 |
| 7 | .02018843 | 8 | .01816958 | 9 | .08075371 |
| 10 | .02254374 | 11 | .02658143 | 12 | .02456259 |
| 13 | .01816958 | 14 | 06056528 | 15 | .01615074 |
| 16 | .02018843 | 17 | .03061911 | 18 | .01615074 |
| 19 | .02254374 | 20 | 01816958 | 21 | .02456259 |
| 22 | .02658143 | 23 | .02456259 | 24 | .02456259 |
| 25 | .01816958 | 26 | .03465680 | 27 | .03061911 |
| 28 | .03061911 | 29 | .01816958 | 30 | .01009421 |
| 31 | .01816958 | 32 | .02018843 | 33 | .04306864 |
| 34 | .01211306 | 35 | .01816958 | 36 | .02254374 |
| 37 | .02018843 | 38 | .02658143 | 39 | .01413190 |
| 40 | .01211306 | 41 | 02018843 | 42 | .02456259 |
| 43 | .03061911 | 44 | .01413190 | 45 | .01413190 |
| 46 | .02254374 | 47 | .01816958 | 48 | .02018843 |
| 49 | .02254374 | | | | |

A weighted random system for choosing numbers was used which employed the above odds. Thus, as an example, this system was expected to randomly choose the number 5 in about 1.2% (0.01211306) of its random number selections.

It's important to note that most embodiments described herein don't select from only the most likely historical winning numbers, but instead make weighted random selections biased by historical data.

Three winning categories were tracked. these were guessing 3 of the 6, 4 of the 6, and 5 of the 6 winning numbers actually drawn in each game. Each game was run 60,000 times (10 games×60,000 predictions=600,000 predictions used for this comparison)

with the predictions compared to a random selection process similar to California's QUICK-PICK (tm) system. The results were as follows:

| Success in Predicting: | Quick-Pick | Embodiment of the Present Invention | Difference |
|---|---|---|---|
| 3 of 6: | 1:57 | 1:42 | 35.714% |
| 4 of 6: | 1:1,032 | 1:704 | 46.590% |
| 5 of 6: | 1:55,497 | 1:20,000 | 177.455% |

In this example, the embodiment's method of choosing lottery numbers exhibited a significant advantage in predicting future lottery outcomes when compared to random means.

A variation of using a straight moving averages is use of weighted moving averages in which more recent, or more relevant events are given greater influence in determining predicted likelihood of future events. As an example, in computing odds for lottery numbers each of last month's selected numbers might be given double the influence relative to the selected numbers from the month before.

Such weighting may increase as a straight line over a defined period, or may increase exponentially over a defined period, or use other mathematical models including statistical curves or the like.

Other means of manipulating data reflecting physical biases are also possible. Mathematical regressions will determine which method is most effective in predicting the physical biases present in any given lottery or game.

Figure 2:
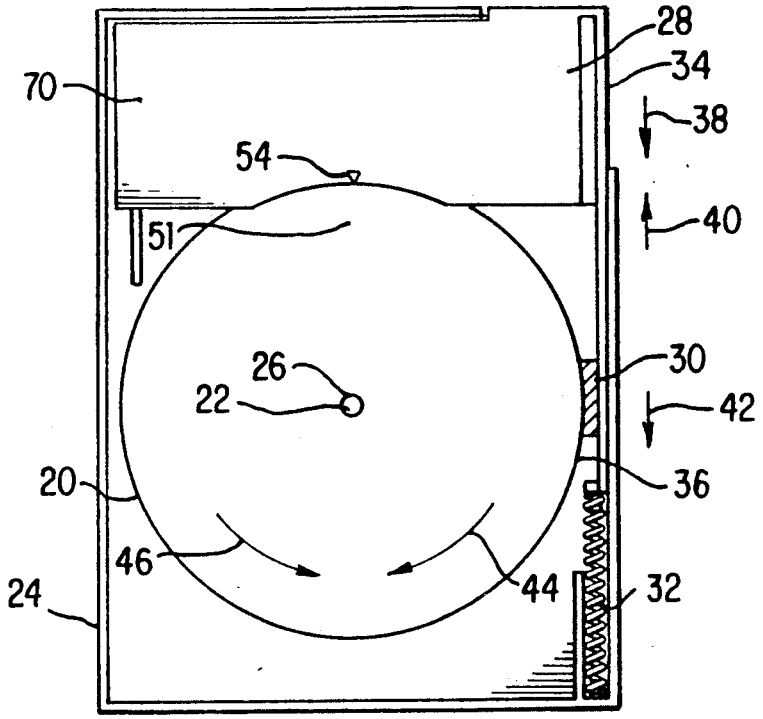
FIG. 2 is a diagrammatic representation of a front sectional view of the game playing device shown in FIG. 1.
Figure 3:
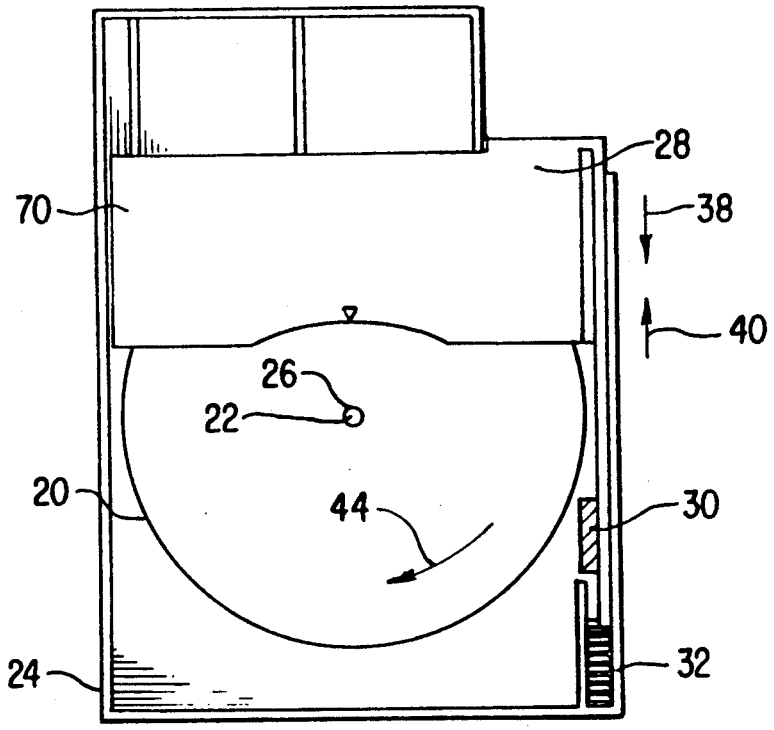
FIG. 3 is the same as FIG. 2 except showing the device while it is being activated.

Referring to FIGS. 1, 2 and 3, the game playing device shown may be constructed at any scale, but is most convenient if constructed to fit within a shirt or coat pocket, or about the size of a mans wallet. This allows the device to be conveniently operated while held in the user's hand, and to be easily transported.

The device has a circular disk 20 (a rotary member), concentrically mounted to an axle 22 which mounts the disk 20 to an outer enclosure 24 (a structural base) by means of one or more low friction bearings 26. A plunger actuator 28 drives 38 a pliable friction pad 30 into and out of frictional engagement with the disk's 20 periphery 36.

The plunger actuator 28 is biased 40 by means of a compression spring 32 to an extended position 34 as shown in FIGS. 1 and 2. In this position, the pliable friction pad 30 is engaged with the disk's 20 periphery 36. Actuation 38 of the plunger 28 through finger or hand pressure or other means causes the pliable friction pad 30 to move 42 tangential to the disk's 20 periphery 36 which in turn causes rotational movement 44 of the disk 20. Near the end of this actuation 38 stroke, the pliable friction pad 30 following a linear path 38 becomes disengaged from the disk's 20 circular perimeter 36 thus leaving the disk 20 to rotate 44 freely about its axle 22 and bearings 26 relative to the outer enclosure 24.

The plunger actuator 28, compression spring 32, and pliable friction pad 30 in combination thus constitute means to initiate rotary motion in said disk 20 (rotary member).

Relaxation of pressure on the plunger actuator 28 causes it to move 40 toward its extended position 34. During this movement 40 the pliable friction pad 30 reengages the disk's 20 periphery 36 causing cessation of the disk's 20 rotational movement 44. Continued movement of the plunger actuator 28 after this reengagement event causes a short amount of rotational disk movement 46 opposite earlier rotational movement 44, followed by non-dynamic disk positioning.

The plunger actuator 28, compression spring 32, and pliable friction pad 30 in combination thus also constitute means to randomly terminate said rotary motion in said disk 20 (rotary member).

Figure 4:
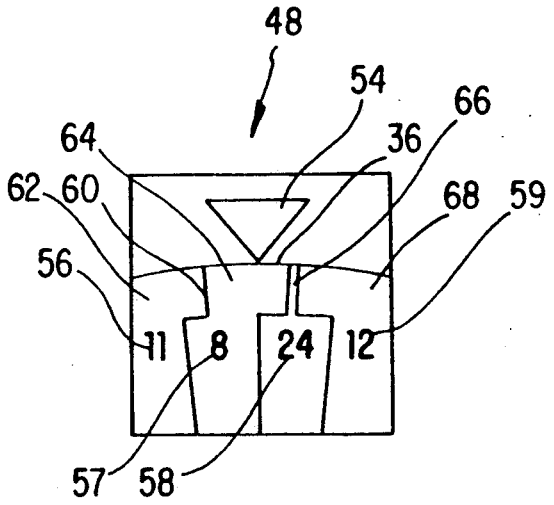
FIG. 4 is a frontal view of the device's disk 20 as viewed through the device's window 48.

A window 48 positioned in the front face 50 of the outer enclosure 24, permits viewing of a portion of the disk's 20 face 51 as well as of an adjacent pointer 54 as shown in FIG. 4. A lens 52 may be placed over the window 48 to enlarge the detail displayed through the window 48.

The disk's 20 face 51 is imprinted with numerical 56 57 58 59 or other markings which correspond to those used in a lottery. Markings 60 on the disk's 20 perimeter 36 graphically identify separable bounded fields 62 64 66 68 which correspond to each imprinted numerical 56 57 58 59 or other marking. The relative size of each bounded field 62 64 66 68 represents the predicted likelihood the number 56 57 58 59 or outcome which corresponds to it will be selected in an upcoming game or lottery drawing. As an example, if the number 5 has a relative predicted chance of 1.2% of being selected in an upcoming lottery game then its field would occupy 4.32 degrees (1.2% × 360 degrees) of the disk's 20 circular periphery 36.

Thus the relative likelihood that any given bounded field 62 64 66 68 on the disk will stop adjacent to the pointer 54 as viewed through the window 48 is equal to the relative likelihood predicted for that number or outcome being drawn in a relevant game or lottery.

The window 48, and pointer 54 in combination thus represent indicator means identifying at least one of said bounded fields after termination of rotary motion by said means to randomly terminate.

In the case of this embodiment of the present invention several factors control which game or lottery number is indicated. These factors include, but are not limited to: the time that the plunger actuator 28 is left depressed, the speed at which it's depressed, the speed at which the disk 20 rotates 44, the relative size of each outcome's bounded field 62 64 66 68, the resistance of the bearings 26 etc. The interaction of these and other factors determine the position that the disk 20 stops and the outcome indicated. Uncertainties in each factor and combinations these factors makes the device weighted but random.

An opaque rigid screen 70 is connected to the plunger actuator 28 and positioned above the disk's 20 face 51. The pointer 54 is imprinted on the screen 70. When the plunger actuator 28 is depressed 38, the screen 70 blocks observation of the disk's 20 face 51 through the window 48.

The window 48, pointer 54, circular disk 20, numerical 56 57 58 59 or other markings, and bounded fields 62 64 66 68 in combination represent display means displaying a single element of a lottery outcome having a plurality of such elements.

The circular disk 20, plunger actuator 28, compression spring 32, pliable friction pad 30, window 48, pointer 54, numerical 56 57 58 59 or other markings, and bounded fields 62 64 66 68 in combination represent means for randomly selecting and presenting potential lottery outcomes.

The pointer 54, circular disk 20, plunger actuator 28, compression spring 32, pliable friction pad 30, window 48, pointer 54, numerical 56 57 58 59 or other markings, and bounded fields 62 64 66 68 in combination represent display driver means. Display driver means are herein defined as those elements which determine a projected lottery outcome.

Display means and display driver means may share elements in common. As an example, the pointer 54, circular disk 20, numerical 56 57 58 59 or other markings, and bounded fields 62 64 66 68 may serve to display a projected lottery outcome (i.e. be display means), as well as to determine a projected lottery outcome (i.e. be display driver means).

Weighted random predictions are herein defined as random predictions which are weighted based on some set of data. An example of this is the above device which is designed to randomly select the number 5 in an average 1.2% of its numerical selections based on historical data of California LOTTO 6/49 outcomes occurring between Jan. 1, 1989 and Jul. 5, 1989.

The term lottery is herein defined as a game of chance where a player wins by correctly guessing a plurality of winning elements, generally numbers, before the same elements are selected by a process conducted by the party conducting the game of chance.

What have been described are certain aspects of apparatus to increase chance predictions of lottery numbers. It is understood that the foregoing descriptions and accompanying illustrations are merely exemplary and are in no way intended to limit the scope of the invention, which is defined solely by the appended claims and their equivalents. Various changes and modifications to the preferred embodiments will be apparent to those skilled in the art. Such changes and modifications may include, but are not limited to: using other means to create randomness such as roulette wheels with unequal ball cradles on the wheels' periphery, or balls which are mixed and then made to align in one or more rows against unequal width fields representing lottery outcomes with a few balls being a different color to identify projected lottery outcomes, or a card deck with several hundred cards with duplicate cards representing more likely lottery outcomes and this card deck being shuffled and selected from; electronic hardware and/or software selection means having circuitry which displays likely lottery outcomes based on weighted random selections determined from historical data; or disks, such as that described, with gearing which make them rotate faster; or wheels which coast to a stop like a casino wheel of fortune and said wheel having unequal peripheral markings representing lottery numbers; or computer programs which make predictions based on random selections of weights determined by historical averages; using embodiments of the invention in other lottery type games such as roulette, wheel of fortune, keno; etc.

Such changes and modifications can be made without departing from the spirit and scope of the invention. Accordingly it is intended that all such changes and modifications be covered by the appended claims and equivalents.

We claim:

1. In combination, a set of statistical data and an apparatus for enhancing chance predictions of a lottery outcome, said set of statistical data being a set of information indicative of past lottery game outcomes, said set of information being collected by monitoring a repetitive lottery game over a set period of time; and said apparatus comprising:

a structural base supporting a rotary member, said rotary member having at least part of its periphery exposed, means to initiate rotary motion in said rotary member, means to randomly terminate said rotary motion in said rotary member, bounded fields marked on said rotary member, each of said bounded fields being defined by differential peripheral indices on said rotary member, said differential peripheral indices being determined by said set of statistical data, and indicator means identifying at least one of said bounded field after termination of said rotary motion by said means to randomly terminate.

2. The combination of claim 1 wherein said rotary member is a disk.

3. The combination of claim 1 wherein said apparatus further includes means to accept a human input and said means to randomly terminate terminates said rotary motion in said rotary member based on a human input accepted by said means to accept human input.

4. The combination of claim 1 wherein said bounded fields occur at the exposed periphery of said rotary member.

5. The combination of claim 1 wherein the size of said bounded fields is directly proportional to a moving average of said past lottery game outcomes.

6. The combination of claim 1 wherein the size of said bounded fields is directly proportional to a weighted moving average of said past lottery game outcomes.

* * * * *